US006076314A

United States Patent [19]

Simonton et al.

[11] Patent Number: 6,076,314

[45] **Date of Patent: *Jun. 20, 2000**

[54] WINDOW FRAME

[75] Inventors: Wayne S. Simonton, Parkersburg; Randall Dwight Holden, Salem, both of W. Va.

[73] Assignee: SLI, Inc., Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/621,719

[22] Filed: Mar. 28, 1996

Related U.S. Application Data

[63] Continuation-in-part of application No. 08/182,587, Jan. 18, 1994, abandoned.

[51] Int. Cl.[7] ..... E06B 1/28

[52] U.S. Cl. ..... 52/204.1; 49/504; 52/204.5; 52/656.5; 52/656.7; 52/734.1; 83/581

[58] Field of Search ..... 49/504; 52/204.1, 52/204.5, 204.51, 204.593, 204.597, 204.62, 213, 656.2, 656.5, 656.6, 656.7, 734.1; 29/557, 558, 897.312; 83/581; 160/90, 91

[56] References Cited

U.S. PATENT DOCUMENTS

| | | | |
|---|---|---|---|
| 1,703,021 | 2/1929 | Voigt | 52/204.5 |
| 2,701,040 | 2/1955 | Wick, Sr. | 160/90 |
| 3,091,008 | 5/1963 | Riegelman | 49/484.1 X |
| 3,099,337 | 7/1963 | Hetman | 52/204.597 |
| 3,924,956 | 12/1975 | Fortier | 52/656.7 X |
| 4,555,868 | 12/1985 | Mancuso | 49/504 X |
| 4,747,248 | 5/1988 | Fahs | 52/656.7 X |
| 4,753,056 | 6/1988 | Pacca | 52/204.593 |
| 4,831,781 | 5/1989 | Morton | 49/504 |
| 4,944,118 | 7/1990 | Biro | 49/504 |

FOREIGN PATENT DOCUMENTS

| | | | |
|---|---|---|---|
| 2150189 | 6/1985 | United Kingdom | 52/204.51 |

*Primary Examiner*—Carl D. Friedman
*Assistant Examiner*—Kevin D. Wilkens
*Attorney, Agent, or Firm*—Cesari and McKenna, LLP

[57] ABSTRACT

A window frame includes a head, a one-piece stepped and sloped bottom sill and one-piece side jambs with integral sash and screen tracks. The side jambs, head and bottom sill are welded together at the corners, such that jamb walls attach to the appropriate walls of the head and sill to form a water-tight frame. The bottom sill is one-piece, with integral sloped steps that form the floors of the various sash and screen tracks. It includes an integral dam and integral internal strengthening walls that are strategically placed to support the otherwise hollow sill. The jamb, which is also one-piece, includes integral internal strengthening walls that correspond to the strengthening walls of the bottom sill, and integral track side and front walls that define the tracks for tie sashes and screen. These walls extend the length of the jamb and connect, when the frame is assembled, to appropriate walls of both the head and the bottom sill. The ends of the walls of the bottom sill and jambs may be cut using for each a cutting tool that simultaneously cuts appropriate walls at a miter-joint angle and cuts other walls at another angle. The tool that cuts the bottom sill cuts the end of the dam at a ninety-degree angle. The tool that cuts the jamb cuts appropriate ones of the track side and front walls to an angle that corresponds to one of the steps of the bottom sill.

11 Claims, 8 Drawing Sheets

WINDOW FRAME

This is a Continuation-In-Part of Ser. No. 08/182,587 filed Jan. 18, 1994, now abandoned.

FIELD OF THE INVENTION

This invention relates generally to window frames and, more particularly, to the construction and assembly of side jambs and sills.

BACKGROUND OF THE INVENTION

A window frame consists of side jambs interconnected by a head and a bottom sill. The side jambs include tracks through which sashes move as the window opens and closes. The side jambs may also include a track for a window screen.

The fames are designed and constructed to inhibit the intrusion of water into the interior of the building into which the frame is installed. Accordingly, to direct water away from the building, the bottom sills in known prior assemblies are often vented or sloped and/or include stepped inserts. Water infiltration through the head sill is not generally a problem, and thus, the top, or head, is not typically vented, sloped or stepped.

The window frame must be carefully assembled, to avoid, as much as possible, openings through which water can enter and accumulate in the frame itself and/or seep from the frame into the interior of the building. The difficulty is that the side jambs and the bottom sill have shapes that are essentially incompatible.

To facilitate attachment of the side jambs and the bottom sill, the jambs in prior known assemblies consist of two or more detachable sections, namely, a base shaped to mate with the sill and one or more inserts that form the tracks. Either the base or the inserts must include openings into which tabs on the other fit to hold the sections together. Such a frame is constructed by connecting the jamb bases to at least the bottom the sill by, for example, welding them together at the corners. The inserts for the tracks are then attached to the bases. The ends of the inserts are thus not affixed to the bottom sill. While such an assembly is relatively water tight, water may enter the assembly either through the openings for receiving the inserts or the openings between the ends of the inserts and the bottom sill.

Constructing these prior known frames is labor intensive, requiring the series of welding and assembly steps discussed above. The bottom sill may also require assembly, if it includes stepped inserts. Such labor intensive assembly processes are expensive, increasing the cost of the assembly. Manufacturing the various sections of the jamb is also costly, since the inserts and the base must be separately produced.

SUMMARY OF THE INVENTION

The invention is a window frame which includes a head, a one-piece stepped and sloped bottom sill and one-piece side jambs with integral sash and screen tracks that mate with the head and bottom sill. The side jambs, head and bottom sill are welded together at the corners, such that jamb walls attach to the appropriate walls of the head and sill to form a water-tight frame. The invention further includes a novel method of cutting the ends of the side jambs and bottom sill.

The bottom sill is one-piece, preferably constructed of extruded vinyl, with sloped steps that form the floors of the various sash and screen tracks. The bottom sill consists of a bottom wall and interior and exterior end walls, a sloped and stepped top wall, and a dam that is essentially a continuation of the interior end wall. A portion of the top wall extends outwardly from the exterior end wall, to form the floor of the screen track.

The bottom sill is essentially hollow, to minimize the weight of the frame. Accordingly, it includes strategically placed internal strengthening walls.

The jamb, which is also one-piece and preferably constructed of extruded vinyl, includes back, side and internal walls that correspond to the bottom, end and internal strengthening walls of the bottom sill. It also includes as an integral part thereof track side and front walls. The track side walls define the tracks for the sashes and screen and the front walls essentially position the sashes properly within the tracks. These walls extend the length of the jamb and connect, when the frame is assembled, to appropriate walls of both the head and the bottom sill.

As discussed in more detail below, the ends of the bottom sill and the jambs are each cut using a novel process. This process utilizes a cutting tool with two independently operating blades To cut the bottom sill, one blade of the cutting tool is set at an angle associated with the miter joint and the second blade is set at a ninety degree angle. The first blade cuts the peripheral and strengthening walls of the sill, which are the walls that connect to the jamb to form the miter corner joint. The second blade simultaneously cuts the ends of the dam and the extension of the top wall that protrudes outwardly from the exterior end wall.

To cut the end of the jamb, the first blade is set to the same angle as the first blade of the sill cutting tool and the second blade is set at an angle that matches the slope of the steepest step of the bottom sill. The first blade cuts the back wall and the internal, external and track side walls, which are the wall that form the second half of the miter corner joint The second blade cuts ends of the track front walls, which are the walls that connect to the stepped and sloped top wall of the bottom sill. The ends of these front walls are then mill cut, to match their lengths to steps of the top wall of the bottom sill.

The head is of conventional design, and it is thus not sloped or stepped. Accordingly, the ends of head and the top ends of the jambs need not be cut at the double angles discussed above. Instead these ends are cut, using a conventional cutting tool, to an angle that corresponds to a miter corner joint.

Once the side jambs, head and bottom sills are appropriately cut, they are welded together across their entire profiles. Preferably, two sets of heated welding plates are used, a first set that matches on one side the profile of the bottom end of the jamb and on the other side the profile of the bottom sill, and a second set that matches on one side the profile of the top end of the jamb and on the other side the profile of the head. These heated plates soften the ends of each of the walls, such that when the ends are connected together the corresponding walls fuse, or weld, to form essentially water-tight connections.

These manufacturing and assembly processes include only a portion of the steps required to manufacture and assemble prior known window frames. The head, sill and jambs are each one-piece, and thus, can be manufactured in one step. Also, the ends of the head, sill and jamb each are cut in one step. Accordingly, the steps of separately cutting the ends of the various track inserts and/or step inserts are elimiated. Finally, the steps of attaching these inserts to a welded frame assembly are eliminated.

BRIEF DESCRIPTION OF THE DRAWINGS

The above and further advantages of the invention may be better understood by referring to the following description in conjunction with the accompanying drawings, in which.

DETAILED DESCRIPTION OF ILLUSTRATIVE EMBODIMENTS

Figure 1:
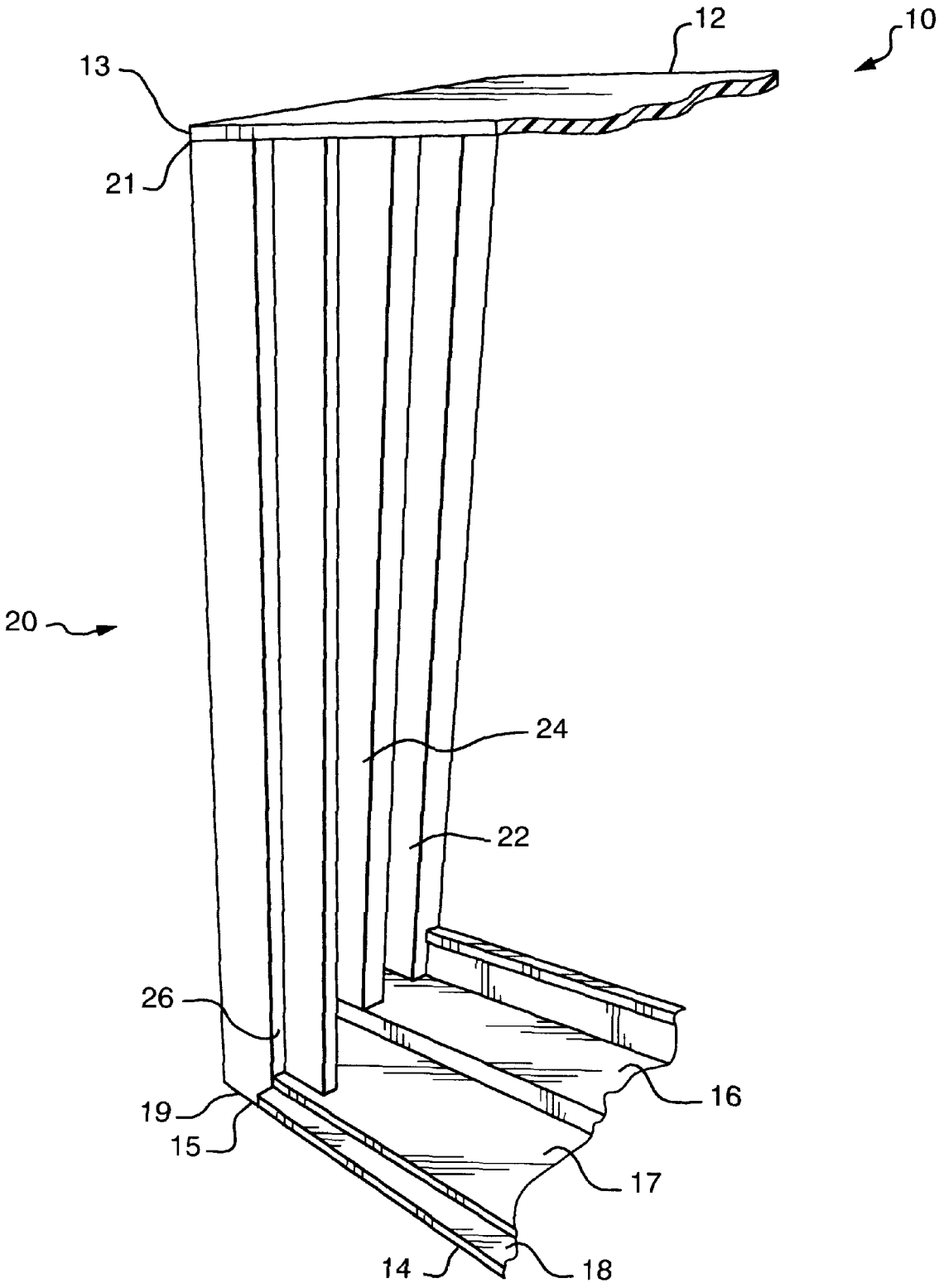
FIG. 1 depicts a portion of a frame assembly constructed in accordance with the current invention.

FIG. 1 depicts one half of a window frame 10. The frame includes a head 12, a bottom sill 14 with integral sloped steps 16–18 and a side jamb 20, with integral tracks 22, 24 and 26 for receiving, respectively, a lower sash, an upper sash and a screen. A bottom end 19 of the jamb 20 connects to one end 15 of the bottom sill 14. A top end 21 of the jamb 20 connects to one end 13 of the head 12. A second side jamb (not shown), which is identical to the side jamb 20, connects to the second ends (not shown) of the head 12 and the bottom sill 14 to complete the frame 10. The side jamb 20, head 12 and bottom sill 14 are each one-piece and are preferably constructed of extruded vinyl.

Figure 2:
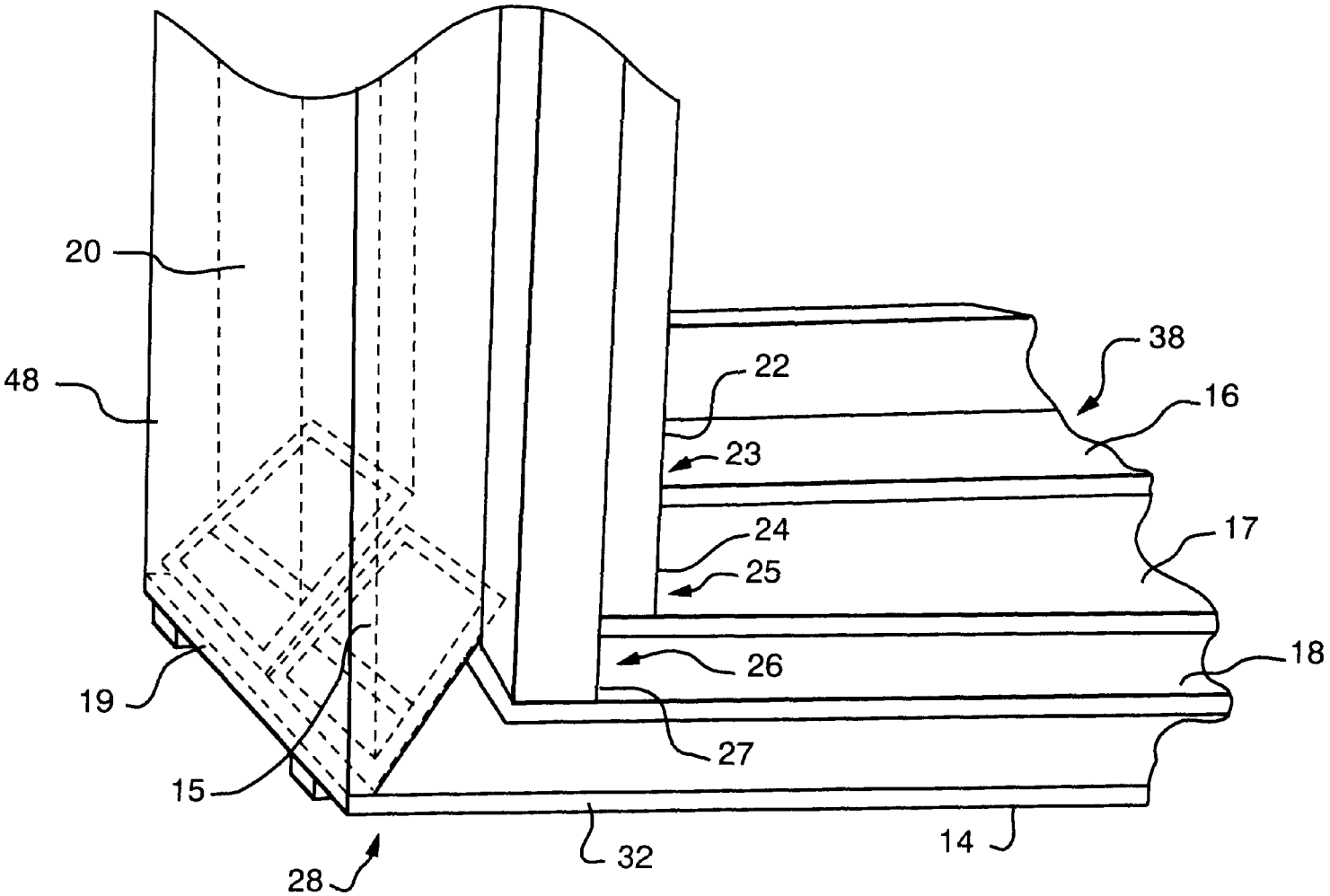
FIG. 2 is a isometric view of the frame assembly of FIG. 1.

Referring to FIG. 2, the end 15 of the bottom sill 14 and the bottom end 19 of the jamb 20 meet at a miter corner joint 28, and also at the ends of walls that form the tracks 22, 24 and 26. These walls connect to the steps 16–18, which are formed by a top wall 38 of the bottom sill 14. The wall that forms the track 22 is hidden from view in the drawing. A back wall 48 of the jamb connects to a bottom wall 32 of the bottom sill to form the exterior of the frame 10, as discussed in more detail below with reference to FIGS. 3–5. The internal walls of the bottom sill and the jamb, which are not visible from the exterior of the frame, are sketched in relief (by dotted line) in the drawing. The entire top end 21 of the jamb 20 and the end 13 of the head 12 (FIG. 1), and thus all their walls, meet at a miter corner joint (not shown). As discussed in more detail below, the ends 21 and 19 of the jamb 20 are welded to the respective ends 13 and 15 of the head and the bottom sill, such that the ends fuse together across essentially their entire profiles.

Figure 3:
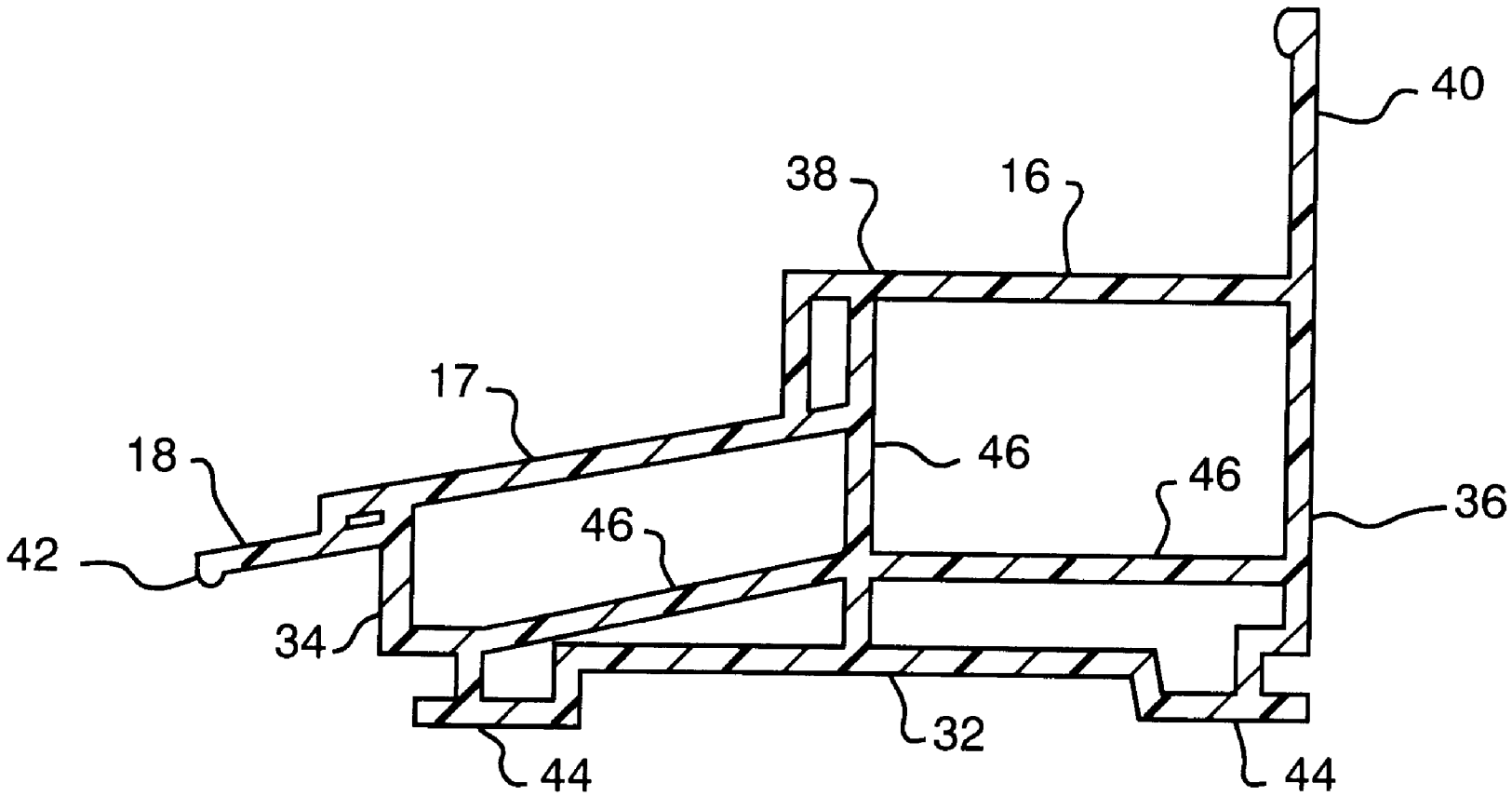
FIG. 3 is a cross-sectional view of the bottom sill.

FIG. 3, is a cross-sectional view of the bottom sill 14. The bottom sill 14 includes of a bottom wall 32 that connects to an exterior end wall 34 and an interior end wall 36. The sill 14 further includes a stepped and sloped top wall 38 and a dam 40 that extends upwardly from the top wall 38. The top wall 38 forms the steps 16–18, with the step 18 consisting of a lip 42 that extends beyond the exterior end wall 34. The steps are each sloped, with the top step 16 having a slight slope and the steps 17 and 18 having identical, steeper slopes. In the preferred embodiment, the top step 16 has a 2° slope and the middle and lower steps 16 and 18 have 10° slopes. The bottom wall 32 supports downwardly extending tabs 44, that fit into corresponding detents in a structure (not shown) in which the frame is installed.

Figure 4:
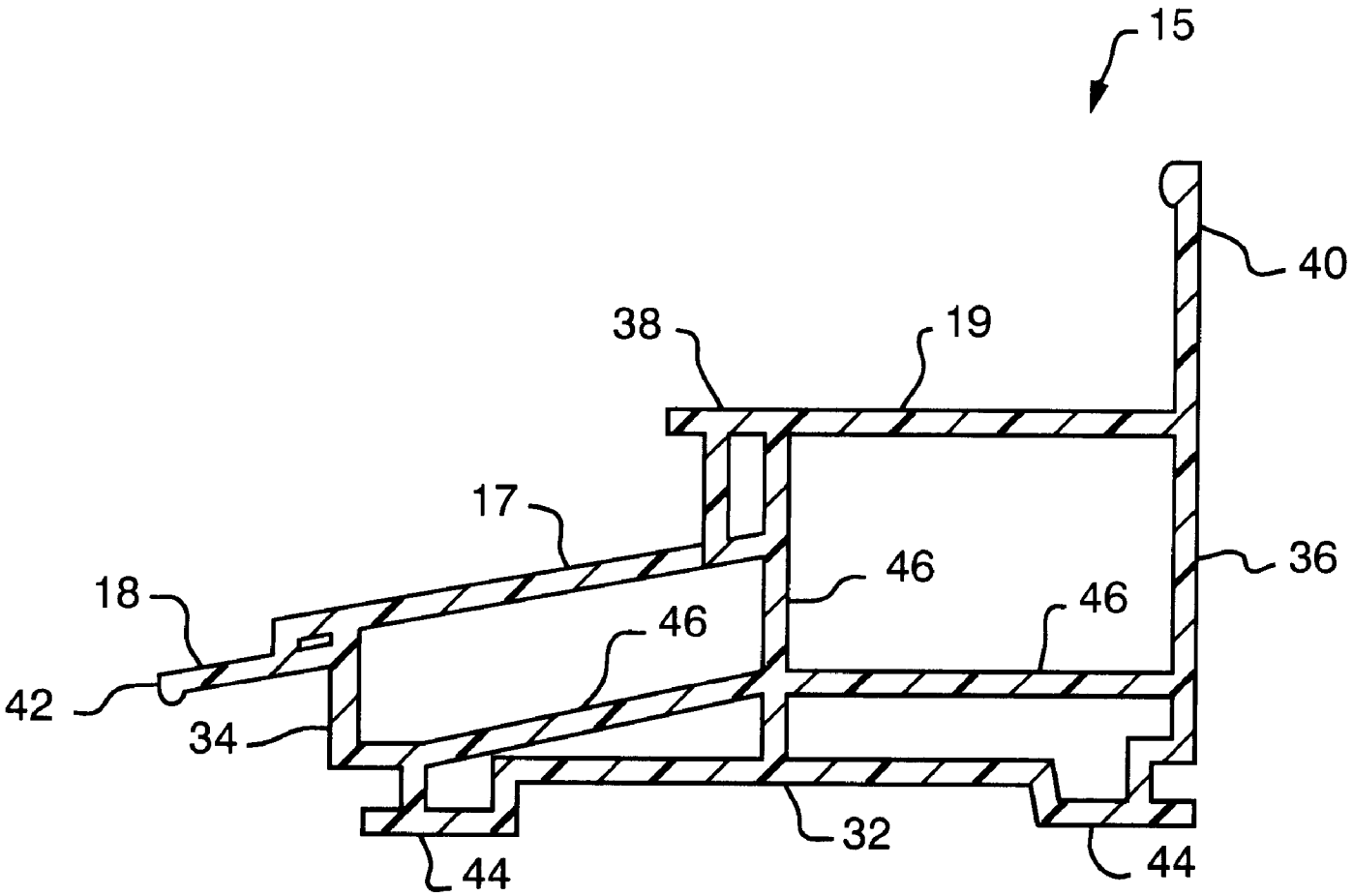
FIG. 4 is a cross-sectional view of an alternative bottom sill.

FIG. 4 depicts an alternative bottom sill 15 in which the top step 19 is flat and the lower steps 17 and 18 have the identical slopes of those in FIG. 3. In the discussion of FIGS. 5–8 below, the references to the bottom sill 14 apply as well to the bottom sill 15.

The sill 14 is hollowed, to reduce the weight of the frame. For strength, the bottom sill 14 includes internal strengthening walls 46 that are strategically placed to support each of the steps 16–18.

The ends of each of the bottom wall 32, the two end walls 34 and 36, the portion of the top wall 38 that extends between these two end walls and the strengthening walls 46 form one-half of the miter corner joint 30. The dam 40 and the lip 42 connect, respectively, to side walls 52 and 54 of the jamb 20 (FIGS. 4 and 5), as discussed below.

Referring to Figs. S and 6, the jamb 20 includes a back wall 48 that supports tabs 50. This wall 48 connects to the bottom wall 32 of the bottom sill 14, such that the tabs 50 attach to the tabs 44 when the two are assembled to form the frame. The jamb 20 also includes interior and exterior side walls 52 and 54, that connect, respectively, to the interior and exterior end walls 36 and 34 of the bottom sill. Internal walls 56 correspond and connect to the strengthening walls 46 of the bottom sill 14.

The jamb 20 further includes track side and front walls, referred to generally by the numerals 58 and 60, that define the tracks 22, 24 and 26. The track side walls 58 correspond to the steps 16–18 of the bottom sill 14. The track front walls 60 essentially position for the upper and lower window sashes (not shown) within the appropriate tracks. Similarly oriented walls 61 act as stops for the sashes and screen, preventing them from penetrating too deeply into the tracks.

To reduce the weight of the assembly, the jamb 20 is hollowed, and thus, internal track strengthening walls 62 are strategically placed to provide support for the track side walls 58. The track 26 for the screen extends outwardly from the exterior side wall 54, and thus, includes a shaped exterior track wall 64.

As discussed above with reference to FIG. 3, the bottom two end and top walls 32, 34, 36 and 38, as well as the associated strengthening walls 46 of the bottom sill form one half of the miter joint 30. The bottom ends of the back, two side and internal walls 48, 52, 54 and 56 and the track side walls 58 of the jamb 20, form the other half of the miter corner joint All these walls must thus be cut at an angle.

The dam 40 and the protruding lip 42 connect to vertical edges of the interior and exterior side walls 52 and 54 of the jamb 20. Accordingly, their ends must be straight cut.

The bottom ends of the track front walls 60 of the jamb 20 connect to the stepped and sloped top wall 38 of the bottom sill 14. As discussed in more detail below, the ends of these front walls 60 are cut at an angle that matches the slope of the steepest of the steps 16–18, and one or more of these ends are then shortened, as necessary, to match their lengths to the height of the steps. The walls 60 that attach to the top step are thus shortened and cut at a slight angle, to match the height and slope, if any, of the step.

Figure 7:
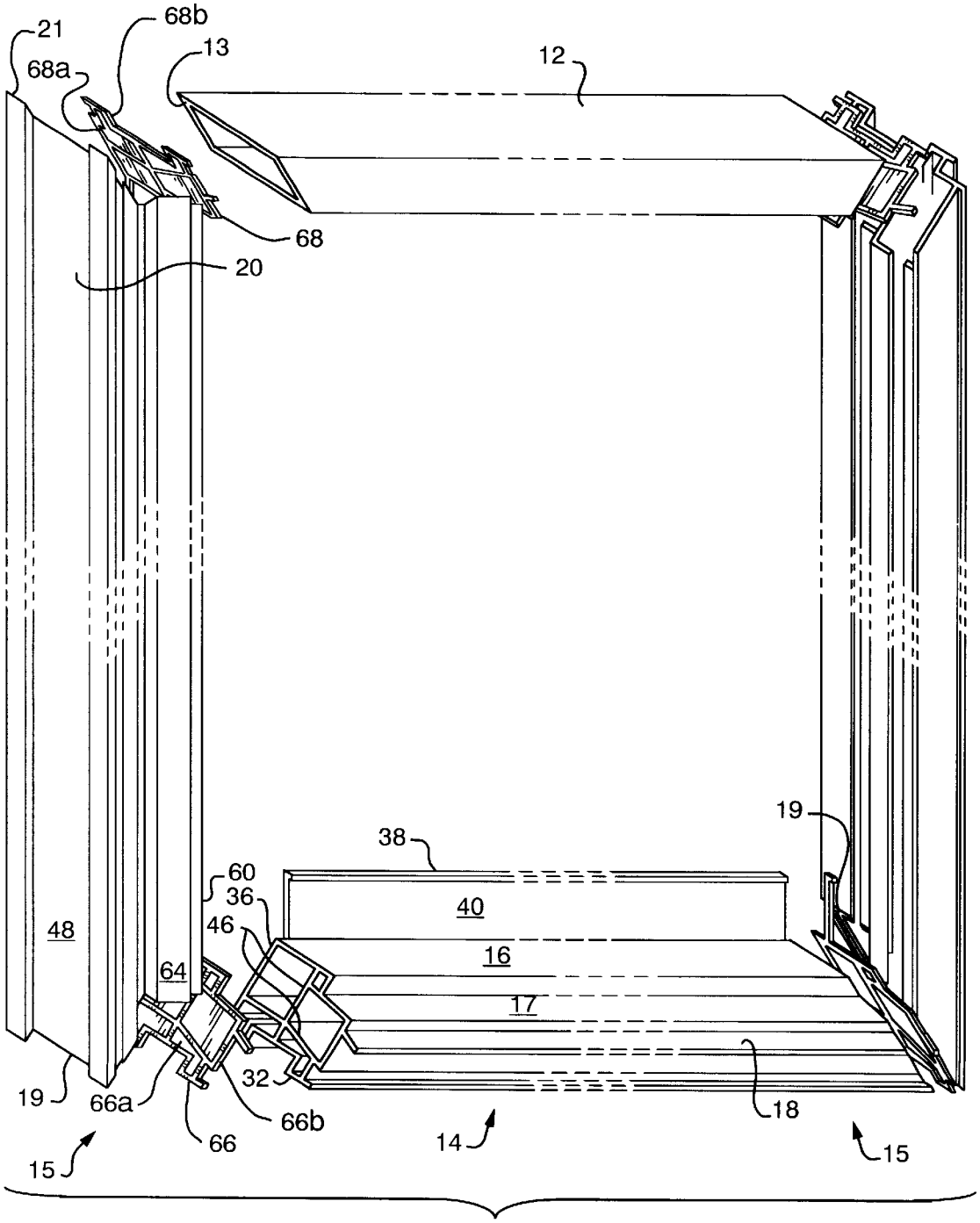
FIG. 7 depicts the frame assembled for welding.

The entire top end 21 of the jamb, including the top ends of the front walls 60 and the end 13 of the head 12 are each cut at an appropriate angle, to form a mitered corner joint Referring now to FIG. 7 once the four ends of each of the jambs 20, head 12 and bottom sill 14 are properly cut, they are welded together. The ends are first aligned with top and bottom heating plates 66 and 68. The bottom heating plate 66 matches on one side 66*a* the profile of the bottom 19 of the jamb 20, including all of the internal strengthening walls of the jamb, and on the other side 66*b* the profile the end 15 of bottom of the sill 14 similarly including all of the internal strengthening walls. The top heating plate 68 matches on one side 68*a* the entire profile of the top end 21 of the jamb 20 and on the other side 68*b* the entire profile of the end 13 of the head 12. These two sides of the top plate 68 should be identical, since the ends 13 and 21 are cut across their entire profiles at the angle corresponding to the miter corner joint When the four ends are softened by the heating plates 66 and 68, the plates are removed and the ends are brought together such that the internal and external walls of the jamb are in direct contact with the corresponding internal and external walls of the head and the bottom sill. As the ends cool these walls fuse, or weld, together to form an essentially water-tight frame.

The frame is assembled in fewer steps than the prior known frames, in part because the steps of attaching various track sections to the jamb back wall after welding are eliminated. Further, no assembly is required of the bottom sill, since the sloped steps are integral to the sill.

For aesthetic reasons, a plug (not shown) may be installed at the end of the lower sash track 22, to cover the gap between the end of the track floor, which is the angle cut, and the wall 61 which acts as a stop for the lower sash. Without the plug, the gap extends down to a strengthening wall of the bottom wall that connects to the stop wall 61, is as discussed above. The plug hides from view any "scarred" edges which may be produced during the welding operation. If water enters the frame through this plug, the water is directed to a drain in the exterior end wall of the bottom sill through corresponding drains (not shown) in the intervening strengthening walls.

Figure 5:
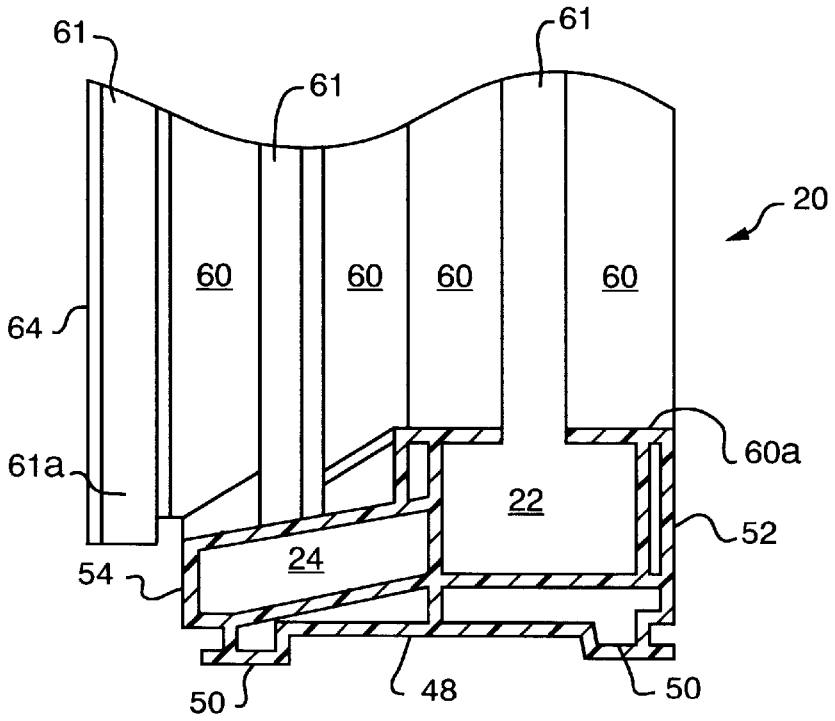
FIG. 5 is a cross-sectional view of the jamb, showing the integral tracks.
Figure 6:
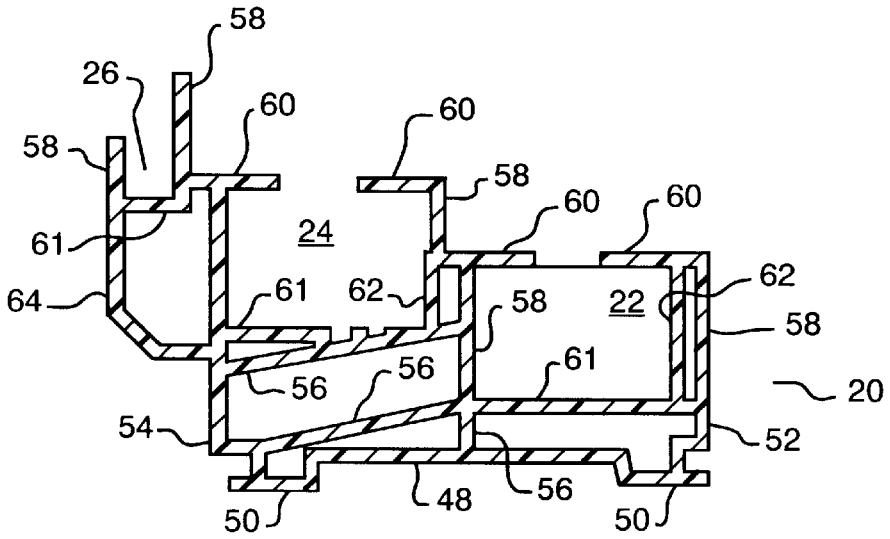
FIG. 6 is a cross-sectional view illustrating the peripheral walls of the jamb.

Referring again to the cross-sectional views of the bottom sill and jamb in FIGS. 3–5, the sill and jambs may be cut in a conventional manner using conventional saws. However, they are preferably cut using a novel process that involves a minimum number of cutting steps, as discussed below with further reference to FIGS. 8 and 9. Unless otherwise noted, all angles referred to in the discussion are relative to horizontal.

Figure 8:
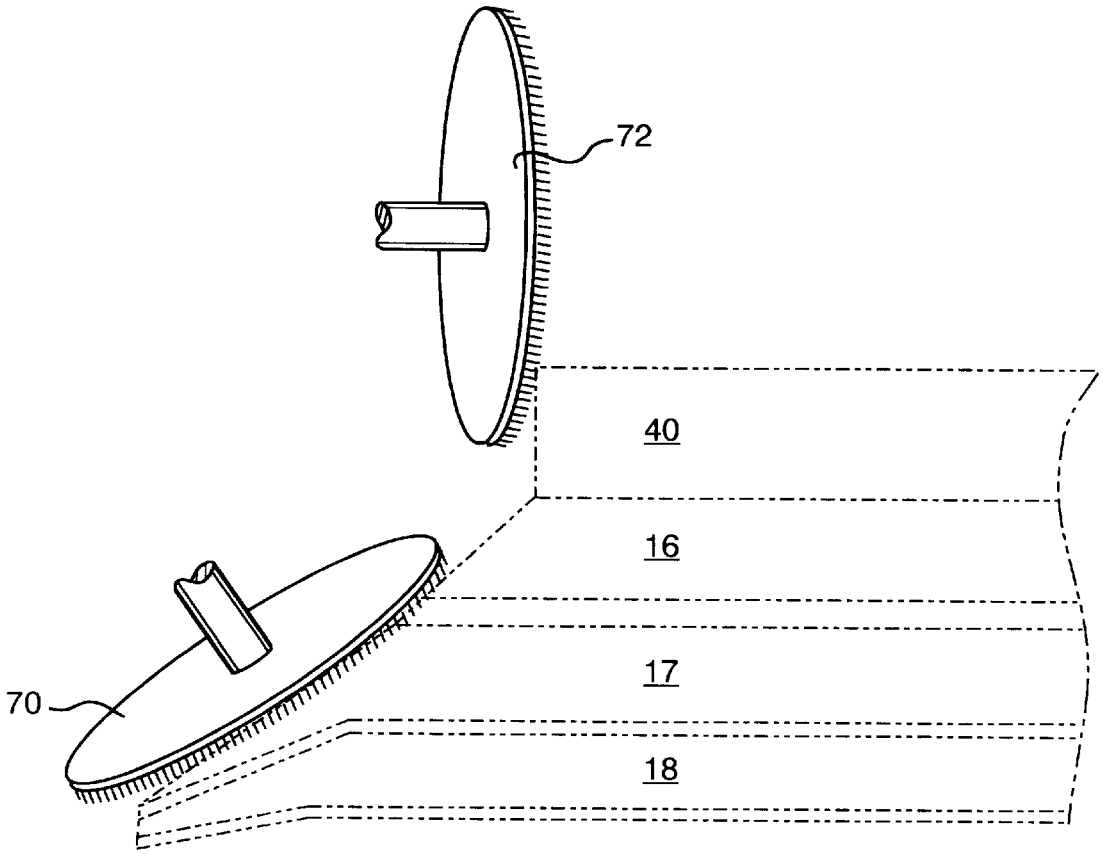
FIG. 8 illustrates a double-bladed cutting tool used to cut the bottom sill of FIG. 3.

FIG. 8 depicts a double-bladed cutting tool that is used to cut the bottom sill, which shown in the drawing in phantom. To form the sill a length of extruded plastic is cut that is one-half inch longer than the length of a finished sill. Next, a first end of the sill is cut from this length of plastic, using the cutting tool of FIG. 8. The two blades of the tool are positioned and angled relative to one another to correspond to the shape of the end of the sill.

The first blade 70 is at a 45° angle, that is, the angle of the miter joint. This blade cuts the ends of the bottom wall 32, the internal strengthening walls 46, the internal and external end walls 34 and 36, and the end of the portion of the top wall 38 that extends between these two end walls. The second blade 72, which is positioned slightly above, and to the left of the first blade, is held at a 90° angle. This blade straight cuts the end of the dam 40, such that the dam is slightly shorter than the length of the top wall 38 at the interior step 16. The two blades, because of their relative positions and angles can operate simultaneously and independently such that the ends of the walls and the end of the dam are cut in one cutting step.

The sill is then turned around and its second end is cut in the same manner, in a separate, single cutting step. The ends of the protruding lip 42 are cut to match the shape of the screen track 26 in a final cutting step, using a conventional mill saw.

To form the jamb, a length of extruded plastic which is approximately two inches longer than the finished jamb is cut, preferably with a miter-angled saw that cuts the ends to the desired miter joint angle. Next, the bottom end 19 of the jamb is cut by a second double-bladed cutting tool, which is similar to the tool used to cut the ends of the bottom sill.

Figure 9:
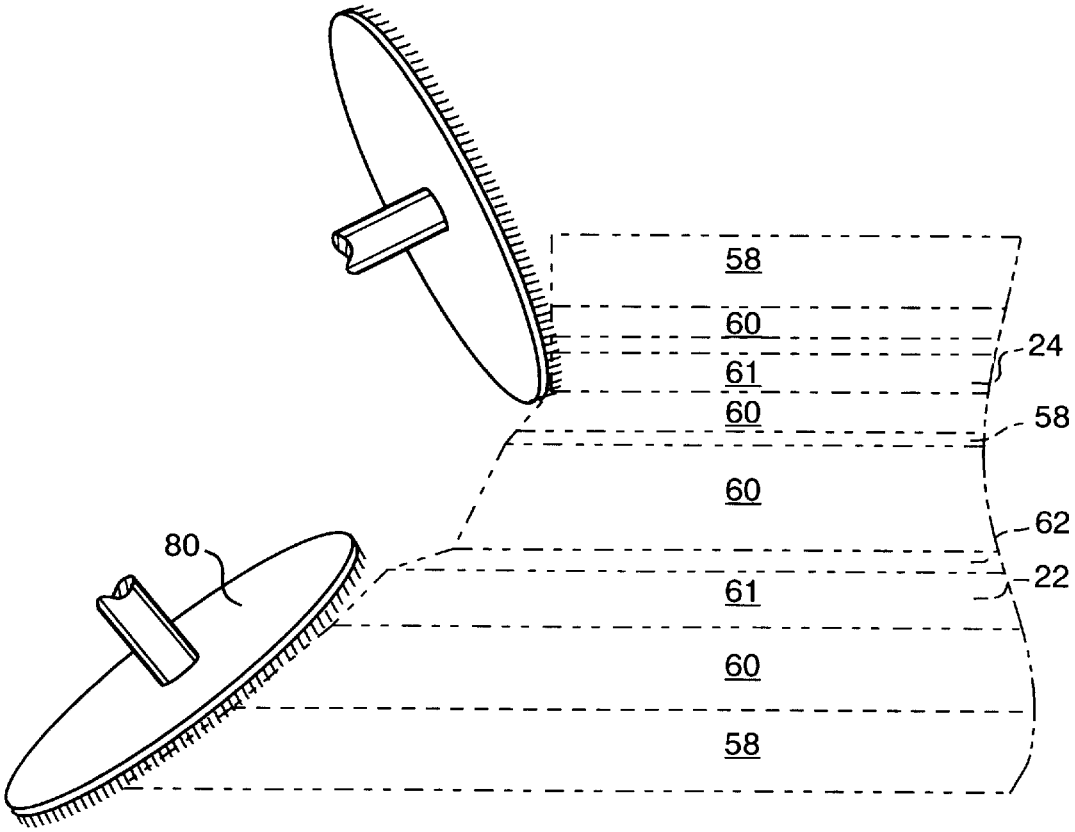
FIG. 9 illustrates a double-bladed cutting tool used to cut the jamb of FIG. 4.

Referring now to FIG. 9, the first blade of the cutting tool is held at 45° angle and the second blade 82 is positioned to the left of and above the first blade and is held at a 30° angle from vertical. The first blade 80 cuts the back wall 48, the interior, exterior and strengthening walls 56, 58, and 60 of the lower-sash track 22, and the strengthening walls 56 of the upper-sash track 24 (all shown in phantom in the drawing). The second blade 82 cuts the track front walls 60 and the stop walls 61 of the upper-sash track 24. The blades are positioned relative to one another such they cut the various walls of the jamb in a single cutting step.

As a last step, the ends of the interior wall of the upper-sash track 24 and the ends of the walls 58 and 61 of the screen track 26 are cut to appropriate lengths, using a conventional computerized router.

The front wall 60 that is the interior wall of the track 24 for the upper sash connects to the top step 16. The floor of this track 24 is the middle step 17 of the top wall 38, and thus, a portion of this front wall overhangs but does not connect to the track floor. This does not affect the water-tight structure of the frame, however, since the walls that define the back and sides of this track are fully attached to the corresponding walls of the bottom sill. Any water that enters this track is directed to the exterior of the frame by the stepped and sloped top wall.

The foregoing description has been limited to specific embodiments of this invention. It will be apparent, however, that variations and modifications may be made to the invention, with the attainment of some or all of its advantages. Therefore, it is the object of the appended claims to cover all such variations and modifications as come within the true spirit and scope of the invention.

What is claimed is:

1. A window frame including:

A. a one-piece extruded vinyl head with internal strengthening walls;

B. a one-piece extruded vinyl bottom sill with a bottom wall, an interior end wall, an exterior end wall, a stepped and sloped top wall and internal strengthening walls that extend between the bottom wall and the stepped and sloped top wall; and C. left and right one-piece extruded vinyl side jambs that attach to the head and the bottom sill, each jamb including i. a back wall, an interior side wall, an exterior side wall, track side walls that separate the jamb into a plurality of tracks and internal strengthening walls that extend between the back wall and the track side walls, the walls having top ends and bottom ends with the top ends sealing to the head such that the internal strengthening walls of the jamb seal to corresponding internal strengthening walls of the head, and the bottom ends sealing to the bottom sill such that the back wall seals to the bottom wall, the interior side wall seals to the interior end wall, the exterior side wall seals to the exterior end wall, the internal strengthening walls of the jamb seal to corresponding internal strengthening walls of the sill and the track side walls mate with the top wall; and ii. track front walls extending from the track side walls of the respective tracks, the track front walls including top and bottom ends, with the top ends mating with the head and the bottom ends mating with a top surface of the top wall of the bottom sill.

2. The window frame of claim 1, wherein the track front walls are cut at lengths associated with the steps of the top wall of the bottom sill.

3. The window frame of claim 1, wherein ends of the walls of the bottom sill are angle cut and the back and side walls of the jamb are cut at a corresponding angle, wherein the ends of the walls of the sill and ends of the back wall and the side walls of the jamb are sealed together to form a mitered corner joint.

4. The window frame of claim 1 wherein the stepped and sloped top wall includes a top step that is horizontal and two lower steps that are sloped.

5. The window frame of claim 1 wherein the stepped and sloped top wall includes a top step that is slightly sloped and two lower steps that are more steeply sloped than the top step.

6. The window frame of claim 1 wherein the walls of the jambs seal to the walls of bottom sill by welding.

7. The window frame of claim 6 wherein the head includes a head top wall, a head interior end wall and a head exterior end wall to which the back wall, the interior side wall, and the exterior side wall of the jambs seal by welding.

8. The window frame of claim 1, wherein the one-piece bottom sill includes a dam that connects to the interior end wall and extends above the top wall.

9. The window frame of claim 8 wherein ends of the walls of the bottom sill and the dam are cut simultaneously with a cutting tool that includes two blades that are angled and positioned relative to one another to cut, respectively, the ends of the walls at a miter-joint angle and the end of the dam at a ninety degree angle.

10. The window frame of claim 9, wherein the walls of the jamb form an upper sash track and a lower sash track, each with associated strengthening walls.

11. The window frame of claim 10, wherein the walls of the jamb are cut by a cutting tool that includes two blades that are angled and positioned relative to one another to cut simultaneously to appropriate angles (a) the walls that seal to the walls of the bottom sill that are cut to the mitre-joint angle, and (b) the walls that mate with the sloped steps of the bottom sill to an angle that corresponds to the slope of a steepest step.

* * * * *